United States Patent [19]

Yamaguchi

[11] 4,313,245

[45] Feb. 2, 1982

[54] STRINGER TAPE FOR SLIDE FASTENERS

[75] Inventor: Yoshiharu Yamaguchi, Namerikawa, Japan

[73] Assignee: Yoshida Kogyo, K.K., Japan

[21] Appl. No.: 42,108

[22] Filed: May 24, 1979

[30] Foreign Application Priority Data

Jun. 10, 1978 [JP] Japan ..... 53-79777[U]

[51] Int. Cl.[3] ..... A44B 19/00

[52] U.S. Cl. ..... 24/205.16 R; 139/384 B

[58] Field of Search ..... 139/384 B; 24/205.16 R; 428/229

[56] References Cited

U.S. PATENT DOCUMENTS

| | | | |
|---|---|---|---|
| 2,373,835 | 4/1945 | Jones | 139/384 B |
| 3,487,510 | 1/1970 | Frohlich | 139/384 B |
| 3,487,511 | 1/1970 | Frohlich | 139/384 B |
| 4,123,830 | 11/1978 | Matsuda et al. | 24/205.16 R |

FOREIGN PATENT DOCUMENTS

| | | | |
|---|---|---|---|
| 758533 | 10/1956 | United Kingdom | 139/384 B |
| 256662 | 9/1977 | U.S.S.R. | 139/384 B |

*Primary Examiner*—Henry Jaudon

*Attorney, Agent, or Firm*—Robert E. Burns; Emmanuel J. Lobato; Bruce L. Adams

[57] ABSTRACT

A slide fastener stringer tape has a beaded longitudinal edge comprising a woven tube integral with a tape web and a reinforcing filler extending through the woven tube. The woven tube includes a plurality of threads of synthetic resin, such as textured yarns, which when heated become shrunk to enable the woven tube to fasten the reinforcing filler therein. The woven tube and the reinforcing filler are thus joined firmly together. The reinforcing filler comprises a central core and a warp-knit tube surrounding the central core and extending longitudinally therewith.

4 Claims, 9 Drawing Figures

STRINGER TAPE FOR SLIDE FASTENERS

BACKGROUND OF THE INVENTION

1. Field of the Invention

The present invention relates to a stringer tape for slide fasteners, and a method of manufacturing the same.

2. Prior Art

U.S. Pat. No. 2,373,835 discloses a beaded tape edge comprising a woven sleeve or tube enclosing a cord or a plurality of warp threads bunched together. The cord or warp threads are liable to move longitudinally in the woven sleeve because the cord or warp threads are not firmly fastened by the woven sleeve. In addition, the cord or warp threads can easily be split, crushed, or otherwise deformed when pressed, and frequently fail to provide sufficient mechanical strength to stabilize positionally metallic coupling elements staked on or plastic coupling elements injection-molded on the beaded tape edge.

According to U.S. Pat. No. 4,123,830, a reinforcing cord mounted on an edge of a stringer tape includes a central core and a warp-knit tube surrounding the core and extending longitudinally therewith. The present invention is an improvement over U.S. Pat. No. 4,123,830.

SUMMARY OF THE INVENTION

An object of the present invention is to provide a stringer tape for slide fasteners which includes a longitudinal beaded edge having an increased degree of uniformity and rigidity.

Another object of the present invention is to provide a stringer tape for slide fasteners which has a woven tube at its one longitudinal edge and a reinforcing filler extending through and firmly joined to the woven tube.

Still another object of the present invention is to provide a method of manufacturing a stringer tape for slide fasteners.

According to the present invention, a woven tube on an edge of a longitudinal stringer tape web includes threads of synthetic resin. A reinforcing filler including a warp-knit tube surrounding a central core extends through the woven tube, which is thermally shrunk to clench the warp-knit tube therein.

BRIEF DESCRIPTION OF THE DRAWINGS

The above and other objects, features and advantages of the present invention will become apparent from the following description when taken in conjunction with the accompanying drawings, in which.

DESCRIPTION OF THE PREFERRED EMBODIMENTS

Figure 1:
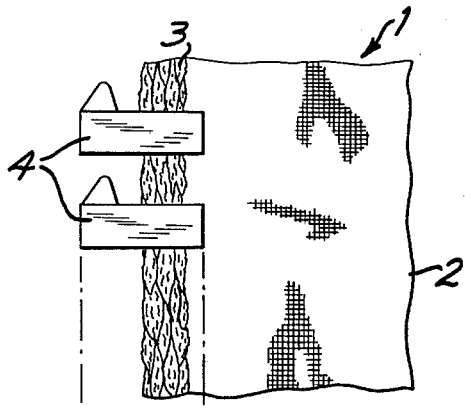
FIG. 1 is a fragmentary plan view of a slide fastener stringer including a stringer tape according to the present invention.

FIG. 1 shows a slide fastener stringer 1 comprising a stringer tape 2 made of a woven fabric having a beaded edge 3, and a series of coupling elements 4 mounted on the beaded edge 3 at predetermined intervals therealong. The coupling elements 4, if made of metal, are staked on the beaded edge 3 or, if made of plastic material, are injection-molded on the beaded edge 3.

Figure 2:
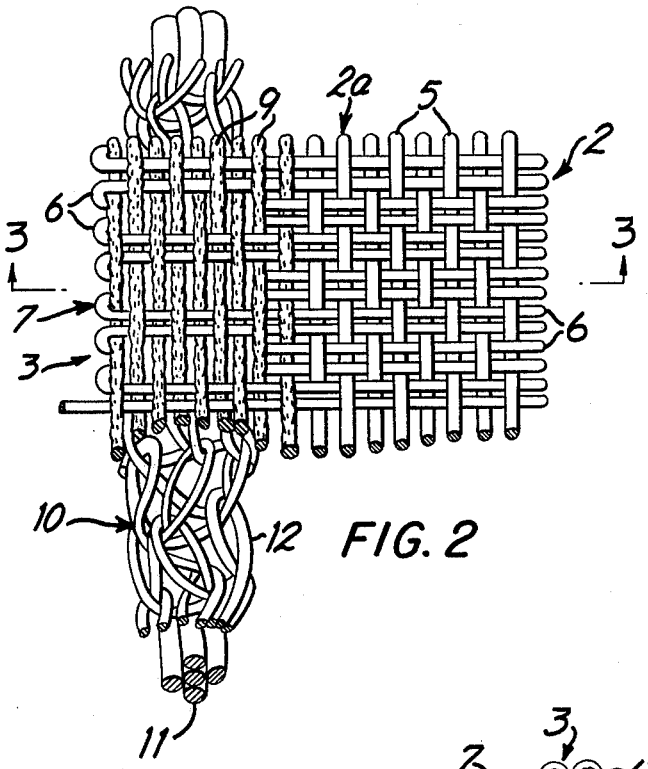
FIG. 2 is an enlarged fragmentary plan view of a stringer tape.
Figure 3:
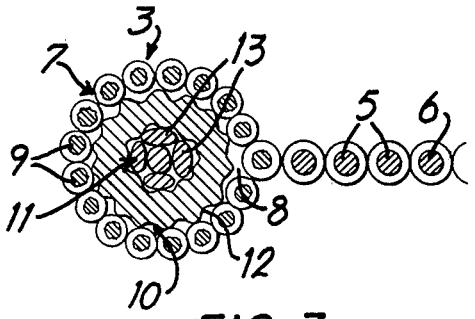
FIG. 3 is a cross section view taken along section line 3—3 of FIG. 2.

As shown in FIGS. 2 and 3, the woven stringer tape 2 includes a longitudinal web 2*a* comprising a plurality of warp threads 5 and a plurality of fillings 6 overlying and underlying the warp threads 5. The woven stringer tape 2 also includes a woven tube or sleeve 7 having a tubular pocket 8 therein constituting part of the beaded edge 3.

The woven tube 7 is comprised of a plurality of warp threads 9 of synthetic fiber which are interlaced by the fillings 6.

A reinforcing filler 10 extends longitudinally through the pocket 8 in the woven tube 7. The reinforcing filler comprises an elongate central core 11 and a warp-knit tube 12 surrounding the central core 11 and extending longitudinally therewith. The central core 11 is composed of a plurality of textured or spun yarns 13 bunched or slightly twisted together. The yarns 13 are not substantially twisted for the purpose of keeping longitudinal stretchability of the central core 11 to a minimum. The use of textured yarns for the central core 11 is particularly preferred in that they do not produce flying threads while the reinforcing filler 10 is being formed.

The warp-knit tube 12 is preferably comprised of textured yarns. The warp-knit tube 12 grips the central core 11 firmly therein with the results that the reinforcing filler 10 is compact and rigid.

The stringer tape 2 thus constructed is subjected to heat treatment. The warp threads 9 of synthetic resin shrink when heated, and enable the woven tube 7 to clench the warp-knit tube 12 therein. The warp-knit tube 12 has roughened surfaces held in intimate contact with the woven tube 7, so that the woven tube 7 and the reinforcing filler 10 are firmly joined together.

Figure 4:
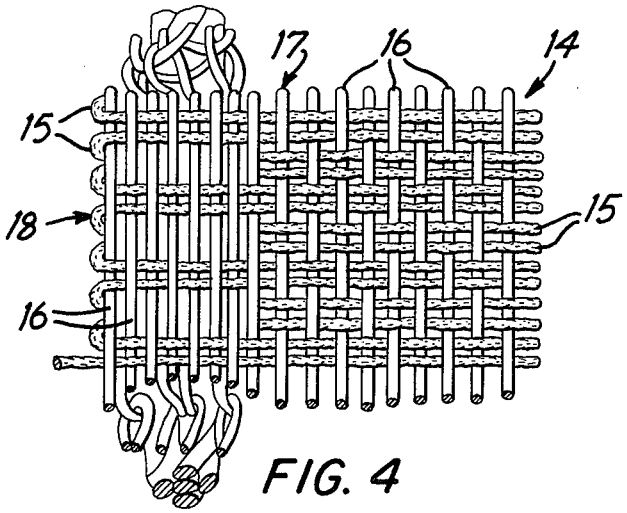
FIG. 4 is an enlarged fragmentary plan view of another embodiment of a stringer tape.

FIG. 4 illustrates a stringer tape 14 according to another embodiment. The stringer tape 14 includes a plurality of fillings 15 made of synthetic fiber which overlie and underlie a plurality of warp threads 16 in a longitudinal web 17 and a woven tube or sleeve 18 of the stringer tape 14.

The warp threads 9 shown in FIG. 2 and the fillings 15 shown in FIG. 4 are preferably composed of textured yarns, which cause the woven tube 12 to grip the warp-knit tube with a greater degree of fastening strength.

Figure 5:
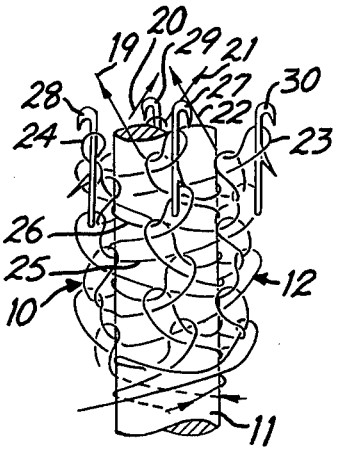
FIG. 5 is an enlarged schematic view of the loop structure of a reinforcing filler.

As best shown in FIG. 5, the warp-knit tube 12 is knitted with four threads 19, 20, 21 and 22 each having a pair of rows of needle loops 23, 24 disposed in diametrically opposed relation and extending longitudinally of the central core 11, and pairs of sinker loops 25, 26 extending circumferentially across and over the central core 11 and between the diametrically opposed rows of needle loops 23, 24.

Two out of the four threads 19, 20, 21 and 22 are paired and their needle loops 23, 24 are intermeshed at diametrically opposite areas of the central core 11, with the sinker loops 25, 26 extending across the central core 11 circumferentially along its diametrically opposite areas. The remaining two threads are similarly paired and interlooped, but are arranged in right-angular relation to the first group of paired two threads. All of the needle loops 23, 24 and the sinker loops 25, 26 are urged into fastening or clinching relation to the central core 11. Thus, the overall structure of the reinforcing filler 10 is compact and rigid. Since the intermeshed needle loops 23, 24 are stretched warpwise, the warp-knit tube 12 and hence the reinforcing filler 10 are resistant to longitudinal stretch.

Formation of the warp-knit tube 12 will be described with reference to FIGS. 5 through 9. The warp-knit tube 12 is made on a circular knitting machine having four latch needles 27, 28, 29 and 30 each angularly spaced 90 degrees apart from adjacent needles with their latches positioned radially outwardly (FIG. 5).

The latch needles 27, 28, 29 and 30 are supported on and extend upwardly from a sleeve (not shown) that is movable up and down. The circular knitting machine also has a guide disk (not shown) located above and concentrically with the sleeve. The guide disk is reciprocably turnable more than 180 degrees about its axis. The guide disk has a central hole coaxial with the sleeve and four apertures located around and each angularly spaced 90 degrees apart from adjacent apertures.

The central core 11 extends through the sleeve and the central hole in the guide disk, and the four threads 19, 20, 21 and 22 extend through the four apertures in the guide disk, respectively. While the sleeve is being moved upwardly to bring the latch needles toward the guide disk, the guide disk is turned about its axis to overlap the needle 27 with the thread 19 (FIG. 6), the needle 28 with the thread 20 (FIG. 7), the needle 29 with the thread 21 (FIG. 8), and the needle 30 with the thread 22 (FIG. 9).

Then, the sleeve is allowed down as the guide disk is rotated back. During continued rotation of the guide disk, the sleeve is moved upwardly again to permit the needle 29 to be overlapped by the thread 19 (FIG. 6), the needle 30 to be overlapped by the thread 20 (FIG. 7), the needle 27 to be overlapped by the thread 21 (FIG. 8), and the needle 28 to be overlapped by the thread 22 (FIG. 9).

Figure 6:
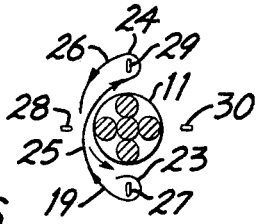
FIGS. 6 through 9 are cross section views each showing the path of supply to a knitting needle of one of the knitting threads for the reinforcing filler of FIG. 5.
Figure 7:
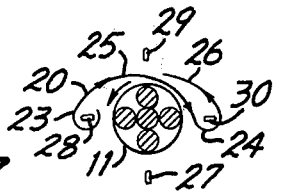
Figure 8:
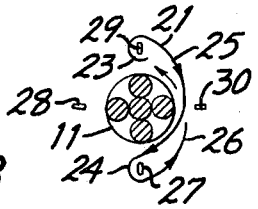
Figure 9:
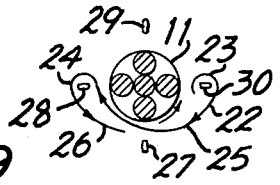

Therefore, while the guide disk is being reciprocally turned and the sleeve is being raised and lowered, the threads 19, 21 are supplied to the diametrically opposed or 180 degrees angularly spaced latch needles 27, 29 in the direction of the arrowheads along the paths substantially in the shape of a figure eight extending at opposite areas of the central core 11 (FIGS. 6 and 8). Similarly, the diametrically opposed latch needles 28, 30 are supplied with the threads 20, 22 which follow in the direction of the arrowheads the paths substantially in the shape of a figure eight extending at opposite areas of the central core 11 (FIGS. 7 and 9). At each latch needle, a needle loop is drawn through a previous needle loop by downward movement of the sleeve.

Although preferred embodiments have been shown and described in detail, it should be understood that various changes and modifications can be made therein without departing from the scope of the appended claims.

What is claimed is:

1. A stringer tape for slide fasteners, comprising:

an elongate woven web having on one longitudinal edge a woven tube defining a tubular pocket, said woven tube being formed integrally with said elongate web and including a plurality of warp threads and a single weft thread, said warp threads of said woven tube being made of thermally shrinkable synthetic resin; and a reinforcing filler extending through said tubular pocket and including an elongate central core and a warp-knit surrounding said elongate central core and extending longitudinally therewith, said warp-knit tube having on its periphery a plurality of longitudinal wales, said warp threads of said woven tube being heat-set and thereby thermally shrunk to clench said warp-knit tube therein so as to be received in interwale grooves between said wales, whereby said woven tube and said reinforcing filler are firmly joined together.

2. A stringer tape for slide fasteners according to claim 1, said central core comprising a plurality of textured yarns bunched together.

3. A stringer tape for slide fasteners according to claim 1, said warp threads of said woven tube comprising textured yarns.

4. A method of manufacturing a stringer tape for slide fasteners which has on one longitudinal edge a woven tube and a reinforcing filler extending through the woven tube, said method comprising:

weaving the woven tube with a plurality of warp threads and a single weft thread, said warp threads being made of thermally shrinkable synthetic resin; and thermally shrinking said warp threads of the woven tube, thereby enabling the woven tube to clench the reinforcing filler.

* * * * *